US008486876B2

(12) United States Patent
Brewer et al.

(10) Patent No.: US 8,486,876 B2
(45) Date of Patent: Jul. 16, 2013

(54) FUNCTIONAL FLUIDS FOR INTERNAL COMBUSTION ENGINES

(75) Inventors: Mark Lawrence Brewer, Ince Chester (GB); David Roy Kendall, Ince Chester (GB)

(73) Assignee: Shell Oil Company, Houston, TX (US)

( * ) Notice: Subject to any disclaimer, the term of this patent is extended or adjusted under 35 U.S.C. 154(b) by 352 days.

(21) Appl. No.: 12/738,520

(22) PCT Filed: Oct. 17, 2008

(86) PCT No.: PCT/EP2008/064071

§ 371 (c)(1),
(2), (4) Date: May 25, 2010

(87) PCT Pub. No.: WO2009/050287

PCT Pub. Date: Apr. 23, 2009

(65) Prior Publication Data

US 2010/0256028 A1 Oct. 7, 2010

(30) Foreign Application Priority Data

Oct. 19, 2007 (EP) ..... 07118869

(51) Int. Cl.
*C10L 1/22* (2006.01)

(52) U.S. Cl.
USPC ..... 508/551; 508/554; 44/412; 44/417

(58) Field of Classification Search
USPC ..... 508/551, 554; 44/412, 417
See application file for complete search history.

(56) References Cited

U.S. PATENT DOCUMENTS

| | | | | |
|---|---|---|---|---|
| 4,208,190 | A | 6/1980 | Malec | 44/53 |
| 4,230,588 | A | 10/1980 | Bonazza et al. | 252/51.5 |
| 4,293,432 | A | 10/1981 | Papay et al. | 252/49.9 |
| 4,729,769 | A * | 3/1988 | Schlicht et al. | 44/418 |
| 4,849,572 | A | 7/1989 | Chen et al. | 585/525 |
| 4,877,416 | A | 10/1989 | Campbell | 44/62 |
| 5,378,348 | A | 1/1995 | Davis et al. | 208/27 |
| 5,490,864 | A | 2/1996 | Herbstman et al. | 44/379 |
| 5,766,274 | A | 6/1998 | Wittenbrink et al. | 44/436 |
| 5,855,629 | A | 1/1999 | Grundy et al. | 44/400 |
| 5,888,376 | A | 3/1999 | Wittenbrink et al. | 208/59 |
| 6,086,645 | A | 7/2000 | Quigley et al. | 44/418 |
| 6,204,426 | B1 | 3/2001 | Miller et al. | 585/739 |
| 6,562,086 | B1 | 5/2003 | Gentry et al. | 44/418 |
| 2003/0009930 | A1 * | 1/2003 | DeRosa et al. | 44/412 |
| 2005/0250655 | A1 | 11/2005 | Adams et al. | 508/287 |
| 2007/0094921 | A1 | 5/2007 | Colucci et al. | 44/408 |

FOREIGN PATENT DOCUMENTS

| | | |
|---|---|---|
| DE | 3826608 | 2/1990 |
| DE | 3838918 | 5/1990 |
| DE | 4142241 | 6/1993 |
| DE | 4309074 | 9/1994 |
| DE | 19620262 | 11/1997 |
| EP | 307815 | 3/1989 |
| EP | 310875 | 4/1989 |
| EP | 356725 | 3/1990 |
| EP | 452328 | 3/1991 |
| EP | 476485 | 3/1992 |
| EP | 583836 | 2/1994 |
| EP | 668342 | 8/1995 |
| EP | 700985 | 3/1996 |
| EP | 776959 | 6/1997 |
| EP | 1029029 | 4/1999 |
| EP | 1101813 | 5/2001 |
| EP | 1230330 | 8/2002 |
| EP | 1272594 | 1/2003 |
| EP | 1295933 | 3/2003 |
| EP | 1435386 | 7/2004 |
| JP | 1302811 | 12/1989 |
| WO | WO8701126 | 2/1987 |
| WO | WO9417160 | 8/1994 |
| WO | WO9424231 | 10/1994 |
| WO | WO9533805 | 12/1995 |
| WO | WO9603367 | 2/1996 |

(Continued)

OTHER PUBLICATIONS

Wei, D., et al: The Lubricity of Diesel Fuels, Wear III, 1986, pp. 217-235.

(Continued)

*Primary Examiner* — James Goloboy
*Assistant Examiner* — Francis C Campanell

(57) ABSTRACT

A functional fluid suitable for use in an internal combustion engine is provided, comprising:

(a) a major amount of a base fluid;

(b) a minor amount of a polysubstituted alkanol amine derivative reaction product obtainable by reacting:

(i) a carboxylate compound of formula I $$R^1COOR^2 \quad (I)$$

in which:

$R^1$ is an aliphatic $C_{1-30}$-hydrocarbon radical; and $R^2$ is hydrogen or alkyl, mono- or polyhydroxyalkyl, or ammonium; with (ii) an alkanol amine of the formula II $$NHR^3R^4 \quad (II)$$

wherein $R^3$ and $R^4$ are independently selected from hydrogen atoms and linear or branched-chain hydrocarbon groups, the carbon chain of which is optionally interrupted by one or more —NH— groups and which optionally has at least one hydroxyl group attached to a carbon atom of the hydrocarbon group, with the proviso that $R^3$ and $R^4$ are not both hydrogen atoms and that at least one of said residues $R^3$ and $R^4$ carries at least one hydroxyl group;

in a molar ratio of the —COO— groups of the carboxylate compound of formula I to the molar sum of OH and NH groups of the alkanol amine of formula II in a range and under reaction conditions supporting the formation of a reaction product comprising polysubstituted alkanol amine derivatives; and (c) a minor amount of a detergent additive.

19 Claims, No Drawings

FOREIGN PATENT DOCUMENTS

| | | |
|---|---|---|
| WO | WO9603479 | 2/1996 |
| WO | WO9703946 | 2/1997 |
| WO | WO9714768 | 4/1997 |
| WO | WO9714769 | 4/1997 |
| WO | WO9721788 | 6/1997 |
| WO | WO9801516 | 1/1998 |
| WO | WO9941332 | 8/1999 |
| WO | WO0008115 | 2/2000 |
| WO | WO0011116 | 3/2000 |
| WO | WO0011117 | 3/2000 |
| WO | WO0014179 | 3/2000 |
| WO | WO0014183 | 3/2000 |
| WO | WO0014187 | 3/2000 |
| WO | WO0014188 | 3/2000 |
| WO | WO0015736 | 3/2000 |
| WO | WO0020534 | 4/2000 |
| WO | WO0020535 | 4/2000 |
| WO | WO0118156 | 3/2001 |
| WO | WO0157166 | 8/2001 |
| WO | WO0183406 | 11/2001 |
| WO | WO0183641 | 11/2001 |
| WO | WO0183647 | 11/2001 |
| WO | WO0183648 | 11/2001 |
| WO | WO2007053787 | 5/2007 |

OTHER PUBLICATIONS

European Search Report, Application No. EP 07118869 2-2104, dated Apr. 4, 2008.

Rudnick, Leslie R., Lubricant Additives—Chemistry and Applications, The Energy Institute, The Pennsylvania State University, Pennsylvania, USA, 2003, pp. 203-221.

Written Opinion, PCT International Searching Authority, International Application No. PCT/EP2008/064071, mailed Apr. 29, 2010.

* cited by examiner

FUNCTIONAL FLUIDS FOR INTERNAL COMBUSTION ENGINES

PRIORITY CLAIM

The present application claims priority of European Patent Application No. 07118869.2 and filed 19 Oct. 2007.

FIELD OF THE INVENTION

The present invention relates to functional fluids suitable for use in an internal combustion engine, more particularly to such fluids which may contain a base fluid in the form of a fuel or lubricating oil; to the preparation of functional fluids suitable for use in an internal combustion engine and to the use of said functional fluids in an internal combustion engine.

BACKGROUND OF THE INVENTION

Reaction products of fatty acid derivatives and alkanol mono- or polyamines are known to be useful additives for application in gasoline and diesel fuel.

Chapter 7: Organic Friction Modifiers, Lubricant Additives: Chemistry and Applications; Leslie R. Rudnick, CRC 2003, ISBN 0824708571. Kenbeek and Buenemann explain that non-acetic organic friction modifiers are preferably long straight-chain molecules with small polar heads. They are described to form adsorption layers on the surface where multiple molecules are adsorbed by hydrogen bonding and Debye orientation forces. Van der Waals forces cause the molecules to align themselves such that they form multimolecular clusters that are parallel to each other. Examples of organic friction modifiers are oleylamide and glycerol monooleate (GMO).

EP-A-1 295 933 describes deposit control additives for direct injected engines available by reaction of monocarboxylic acids and polyamines. Most preferred is a molar ratio of 1 to 1.5 moles of monocarboxylic acid and 1 mole of polyamine. Specific preferred examples are the reaction products of equimolar amounts of tallow fatty acid or oleic acid and AEAE. According to the general procedure disclosed therein the reaction is performed at reflux temperature which is in the range of 150 to 175° C. There is no suggestion made in said document with respect to choosing the reaction conditions (molar ratio and/or reaction temperature) such that polysubstituted alkanolamines are preferentially formed. In particular, it is not suggested to control the kinetics of the reaction by selecting a suitable temperature profile.

Furthermore, there is no disclosure in EP-A-1 295 933 of benefits in terms of improving the fuel economy of internal combustion engines by use of functional fluid compositions whether fuel compositions as fuel for the engine, or lubricating oil compositions for lubricating the engine, which fluid compositions incorporate the product of the reaction of monocarboxylic acids and polyamines.

EP-A-1 435 386 describes fatty acid alkanol amides, which improve the acceleration properties of internal combustion engines. This document describes alkanol monoamides obtainable by reaction of equimolar quantities of a fatty acid or its ester and of an alkanol monoamine.

Improved acceleration response is exemplified for gasoline fuels containing these compounds. Further benefits in terms of increased fuel efficiency, stability of engine rotation during idling and decrease in vibration of the engine and noise are also stated in the description of EP-A-1 435 386, but such additional benefits are not exemplified therein.

EP 1 272 594 describes the use of friction modifiers, which are the reaction products of certain natural or synthetic carboxylic acid glyceryl esters and alkanol amines in combination with a detergent additive in gasoline for improving the delivery of the friction modifier to the lubricant of the engine. The reaction of preparing the friction modifier is performed without applying a specific temperature profile. The specific selection of a significant molar excess of the alkanol amine is neither suggested nor exemplified. Similar friction modifiers are disclosed in WO 2007/053787, where it is suggested to use the same in combination with a solvent, an alcohol and certain compatibilizer to form fuel additive concentrates remaining fluid at −8° C. or below.

Surprisingly, it has been found possible to modify the preparation of alkanol amine derivatives in such a way that the resulting derivatives provide significant benefits, such as fuel economy benefits and improvements in terms of lubricity, when incorporated in functional fluids employed in internal combustion engines. It has additionally been found that these benefits may be further improved by the incorporation of an additional detergent additive.

SUMMARY OF THE INVENTION

According to the present invention, there is provided a functional fluid suitable for use in an internal combustion engine, comprising:

(a) a major amount of a base fluid;

(b) a minor amount of a polysubstituted alkanol amine derivative reaction product (hereinafter "reaction product (b)") obtainable by reacting:

(i) a carboxylate compound of formula I $$R^1COOR^2 \quad (I)$$

in which:

$R^1$ is an aliphatic $C_{1-30}$-hydrocarbon radical; and $R^2$ is hydrogen or alkyl, mono- or polyhydroxyalkyl, or ammonium; with (ii) an alkanol amine of the formula II $$NHR^3R^4 \quad (II)$$

wherein $R^3$ and $R^4$ are independently selected from hydrogen atoms and linear or branched-chain hydrocarbon groups, the carbon chain of which is optionally interrupted by one or more —NH— groups and which optionally has at least one hydroxyl group attached to a carbon atom of the hydrocarbon group, with the proviso that $R^3$ and $R^4$ are not both hydrogen atoms and that at least one of said residues $R^3$ and $R^4$ carries at least one hydroxyl group;

in a molar ratio of the —COO— groups of the carboxylate compound of formula I to the molar sum of OH and NH groups of the alkanol amine of formula II in a range and under reaction conditions supporting the formation of a reaction product comprising polysubstituted alkanol amine derivatives; and (c) a minor amount of a detergent additive.

The present invention further provides a process for the preparation of said functional fluid, which comprises bringing into admixture the base fluid, the reaction product (b) and the detergent additive (c).

DETAILED DESCRIPTION OF THE INVENTION

The functional fluid suitable for use in an internal combustion engine of the present invention may be either a fuel composition, such as a gasoline composition or a diesel fuel composition, or a lubricating oil composition, such as an engine crank case lubricant composition.

In one particular embodiment of the present invention, the functional fluid is a fuel composition and the base fluid is a fuel. For instance, in one specific embodiment of the present invention the functional fluid is a gasoline composition and the base fluid is a gasoline. In another specific embodiment of the present invention the functional fluid is a diesel fuel composition and the base fluid is a diesel fuel By the term "improved/improving lubricity" used herein, it is meant that the wear scar produced using a high frequency reciprocating rig (HFRR) is reduced.

By the term "major amount" used in relation to the amount of the base fluid in the functional fluid of the present invention, it is meant that the functional fluid comprises more than 50 percent by volume of the base fluid, based on the total volume of the functional fluid. Typically, the "major amount" is more than 90 percent by volume, more typically more than 95 percent by volume, of the base fluid, based on the total volume of the functional fluid.

Typically, the "minor amount" is less than 10 percent by volume, more typically less than 5 percent by volume, of reaction product (b) and/or detergent additive (c), based on the total volume of the functional fluid.

Base Fluid

The base fluid may be any fluid which is suitable for use as a functional fluid in an internal combustion engine. Suitable base fluids include fuels, such as gasoline and diesel fuel, and lubricating oil, such as engine crank case lubricants.

The nature of the base fluid is not critical and can be any such fluid known in the art, such as gasoline and diesel fuels, for example, as described in Ullmann's Encyclopedia of Industrial Chemistry, 5th Ed. 1990, Volume A16, p. 719 ff, and Kirk Othmer Encyclopedia of Chemical Tecnology, $4^{th}$ Ed. 1994, Volume 12, p. 341-388. Lubricating oils are described, for example, in "Lubrication Fundamentals", J. George Wells, Marcel Dekker, Inc., New York, 1980.

Where the base fluid is a gasoline, the functional fluid containing it is a gasoline composition; where the base fluid is a diesel fuel, the functional fluid containing it is a diesel fuel composition; and, where the base fluid is a lubricating oil, the functional fluid containing it is a lubricating oil composition Gasoline Gasoline (or gasoline fuel or base gasoline) according to the present invention includes any liquid fuel suitable for use in an internal combustion engine of the spark-ignition (petrol) type. The gasoline may be any gasoline known in the art.

Gasolines typically comprise mixtures of hydrocarbons boiling in the range from 25 to 232° C. (EN-ISO 3405), the optimal ranges and distillation curves typically varying according to climate and season of the year. For example, the summer vapour pressure of gasoline is typically not more than 70 kPa, in particular 60 kPa (each at 37° C.).

The hydrocarbons in gasoline may be derived by any means known in the art, conveniently the hydrocarbons may be derived in known manner from straight-run gasoline, synthetically-produced aromatic hydrocarbon mixtures, thermally or catalytically cracked hydrocarbons, hydro-cracked petroleum fractions, catalytically reformed hydrocarbons or mixtures of these.

The specific distillation curve, hydrocarbon composition, research octane number (RON) and motor octane number (MON) of the gasoline is not critical.

Preferably, the research octane number (RON) of the gasoline is in the range of from 75 to 105, more preferably from 85 to 103, even more preferably from 90 to 100, most preferably from 94 to 100 (EN 25164). The motor octane number (MON) of the gasoline is preferably in the range of from 65 to 105 (for example 65 to 95), more preferably from 75 to 100 (for example 75 to 93), even more preferably from 80 to 95 (for example 80 to 90), most preferably from 84 to 90 (EN 25163).

Typically, gasolines comprise a mixture of saturated hydrocarbons, olefinic hydrocarbons, aromatic hydrocarbons, and, optionally, oxygenated hydrocarbons.

Typically, the olefinic hydrocarbon content of gasoline is in the range of from 0 to 50 percent by volume based on the gasoline. Preferably, the olefinic hydrocarbon content of gasoline is in the range of from 0 to 30 percent by volume based on the gasoline, for example in the range of from 0 to 21 percent by volume, from 6 to 21 percent by volume, in particular from 7 to 18 percent by volume.

Typically, the aromatic hydrocarbon content of gasoline is not more than 60 percent by volume based on the gasoline, for example the aromatic hydrocarbon content is not more than 42 percent by volume, not more than 38 percent by volume or not more than 35 percent by volume. Preferably, the aromatic hydrocarbon content of the gasoline is in the range of from 10 to 60 percent by volume, e.g. from 10 to 50 percent by volume, from 30 to 42 percent by volume, and from 32 to 40 percent by volume.

The benzene content of gasoline is preferably at most 10 percent by volume, more preferably at most 5 percent by volume, especially at most 1 percent by volume, for example 0.5 to 1.0 percent by volume, in particular from 0.6 to 0.9 percent by volume, based on the gasoline.

Typically, the saturated hydrocarbon content of gasoline is at least 40 percent by volume; preferably, the saturated hydrocarbon content of the gasoline is in the range of from 40 to 80 percent by volume.

The gasoline preferably has a low or ultra low sulphur content, for instance not more than 2000 ppmw (parts per million by weight), preferably not more than 1000 ppmw (for example in the range of from 2 to 500 ppmw), more preferably not more than 150 (for example in the range of from 5 to 100 ppmw), even more preferably not more than 50 and most preferably 10 ppmw or less.

The gasoline also preferably has a low total lead content, such as at most 0.005 g/l, most preferably being lead free—having no lead compounds added thereto (i.e. unleaded).

In embodiments wherein gasoline comprises oxygenated hydrocarbons, at least a portion of non-oxygenated hydrocarbons will be substituted for oxygenated hydrocarbons.

When gasoline contains oxygenated hydrocarbons, the oxygen content of the gasoline may be up to 35 percent by weight (e.g. ethanol per se) based on the gasoline. For example, the oxygen content of the gasoline may be up to 25 percent by weight, preferably up to 10 percent by weight, more preferably from 1.0 to 2.7 percent by weight, and even more preferably from 1.2 to 2.0 percent by weight.

Examples of oxygenated hydrocarbons that may be incorporated into gasolines include alcohols, ethers, esters, ketones, aldehydes, carboxylic acids and their derivatives, and oxygen containing heterocyclic compounds. Preferably, the oxygenated hydrocarbons that may be incorporated into gasolines are selected from alcohols (such as methanol, ethanol, propanol, iso-propanol, butanol, tert-butanol and iso-butanol) and ethers (preferably ethers containing 5 or more carbon atoms per molecule, e.g., methyl tert-butyl ether), a particularly preferred oxygenated hydrocarbon is ethanol.

The amount of oxygenated hydrocarbons in gasoline may vary over a wide range. For example, gasolines comprising a major proportion of oxygenated hydrocarbons are currently commercially available in countries such as Brazil and U.S.A. e.g. ethanol per se and E85, as well as gasolines comprising a minor proportion of oxygenated hydrocarbons, e.g. E10. Gasolines may contain up to 100 percent by volume oxygenated hydrocarbons. Preferably, the amount of oxygenated hydrocarbons present in gasoline is selected from one of the following amounts: up to 85 percent by volume; up to 65 percent by volume; up to 30 percent by volume; up to 20 percent by volume; up to 15 percent by volume; and, up to 10 percent by volume, depending upon the desired final formulation of the gasoline composition.

Examples of the maximum contents of alcohols and ethers in specific gasolines are: 15 percent by volume for methanol; 65 percent by volume for ethanol; 20 percent by volume for isopropanol; 15 percent by volume for tert-butanol, 20 percent by volume for isobutanol; and, 30 percent by volume for ethers having 5 or more carbon atoms in the molecule.

Examples of suitable gasolines include gasolines which have an olefinic hydrocarbon content of from 0 to 20 percent by volume (ASTM D1319), an oxygen content of from 0 to 5 percent by volume (EN 1601), an aromatic hydrocarbon content of from 0 to 50 percent by volume (ASTM D1319) and a benzene content of at most 1 percent by volume.

Further examples of suitable gasolines include gasolines which simultaneously have an aromatics content of not more than 38 or 35 percent by volume, an olefin content of not more than 21 percent by volume, a sulfur content of not more than 50 or 10 ppmw, a benzene content of not more than 1.0 percent by volume and an oxygen content of from 1.0 to 2.7 percent by weight.

The gasoline composition may, in addition to reaction product (b) and detergent additive (c), include one or more additive components (or co-additives), such as anti-oxidants, corrosion inhibitors, dehazers, dyes, solvents and synthetic or mineral carrier oils. Examples of suitable such additives are described generally in U.S. Pat. No. 5,855,629. The additives, including reaction product (b) and detergent additive (c), can be added directly to gasoline or can be blended before addition with one or more diluents, to form an additive concentrate (additive package). Unless otherwise stated, the (active matter) concentration of any additives, other than reaction product (b) and detergent additive (c), present in the gasoline composition is preferably up to 1.0 percent by weight, more preferably in the range from 0.1 to 1000 ppmw (e.g. from 5 to 1000 ppmw), advantageously from 0.1 to 300 ppmw (e.g. from 75 to 300 ppmw), such as from 0.1 to 150 ppmw (e.g. from 95 to 150 ppmw).

As stated above, the gasoline composition may also contain synthetic or mineral carrier oils and/or solvents.

Examples of suitable mineral carrier oils are fractions obtained in crude oil processing, such as brightstock or base oils having viscosities, for example, from the SN 500-2000 class; and also aromatic hydrocarbons, paraffinic hydrocarbons and alkoxyalkanols. Also useful as a mineral carrier oil is a fraction which is obtained in the refining of mineral oil and is known as "hydrocrack oil" (vacuum distillate cut having a boiling range of from about 360 to 500° C., obtainable from natural mineral oil which has been catalytically hydrogenated under high pressure and isomerized and also deparaffinized).

Examples of suitable synthetic carrier oils are: polyolefins (poly-alpha-olefins or poly(internal olefin)s), (poly)esters, (poly)alkoxylates, polyethers, aliphatic polyether amines, alkylphenol-started polyethers, alkylphenol-started polyether amines and carboxylic esters of long-chain alkanols.

Examples of suitable polyolefins are olefin polymers having Mn of from 400 to 1800, in particular based on polybutene or polyisobutene (hydrogenated or nonhydrogenated).

Examples of suitable polyethers or polyetheramines are preferably compounds comprising polyoxy-$C_2$-$C_4$-alkylene moieties which are obtainable by reacting $C_2$-$C_{60}$-alkanols, $C_6$-$C_{30}$-alkanediols, mono- or di-$C_2$-$C_{30}$-alkylamines, $C_1$-$C_{30}$-alkylcyclohexanols or $C_1$-$C_{30}$-alkylphenols with from 1 to 30 mol of ethylene oxide and/or propylene oxide and/or butylene oxide per hydroxyl group or amino group, and, in the case of the polyether amines, by subsequent reductive amination with ammonia, monoamines or polyamines. Such products are described in particular in EP-A-310 875, EP-A-356 725, EP-A-700 985 and U.S. Pat. No. 4,877,416. For example, the polyether amines used may be poly-$C_2$-$C_6$-alkylene oxide amines or functional derivatives thereof. Typical examples thereof are tridecanol butoxylates or isotridecanol butoxylates, isononylphenol butoxylates and also polyisobutenol butoxylates and propoxylates, and also the corresponding reaction products with ammonia.

Examples of carboxylic esters of long-chain alkanols are in particular esters of mono-, di- or tricarboxylic acids with long-chain alkanols or polyols, as described in particular in DE-A-38 38 918. The mono-, di- or tricarboxylic acids used may be aliphatic or aromatic acids; suitable ester alcohols or polyols are in particular long-chain representatives having, for example, from 6 to 24 carbon atoms. Typical representatives of the esters are adipates, phthalates, isophthalates, terephthalates and trimellitates of isooctanol, isononanol, isodecanol and isotridecanol, for example di-(n- or isotridecyl) phthalate.

Further suitable carrier oil systems are described, for example, in DE-A-38 26 608, DE-A-41 42 241, DE-A-43 09 074, EP-A-0 452 328 and EP-A-0 548 617.

Examples of particularly suitable synthetic carrier oils are alcohol-started polyethers having from about 5 to 35, for example from about 5 to 30, $C_3$-$C_6$-alkylene oxide units, for example selected from propylene oxide, n-butylene oxide and isobutylene oxide units, or mixtures thereof. Non-limiting examples of suitable starter alcohols are long-chain alkanols or phenols substituted by long-chain alkyl in which the long-chain alkyl radical is in particular a straight-chain or branched $C_6$-$C_{18}$-alkyl radical. Preferred examples include tridecanol and nonylphenol.

Further suitable synthetic carrier oils are alkoxylated alkylphenols, as described in DE-A-10 102 913.6.

Mixtures of mineral carrier oils, synthetic carrier oils, and mineral and synthetic carrier oils may also be used.

Any solvent and optionally co-solvent suitable for use in fuels may be used. Examples of suitable solvents for use in fuels include: non-polar hydrocarbon solvents such as kerosene, heavy aromatic solvent ("solvent naphtha heavy", "Solvesso 150"), toluene, xylene, paraffins, petroleum, white spirits, those sold by Shell companies under the trademark "SHELLSOL", and the like. Examples of suitable co-solvents include: polar solvents such as esters and, in particular, alcohols (e.g. t-butanol, i-butanol, hexanol, 2-ethylhexanol, 2-propyl heptanol, decanol, isotridecanol, butyl glycols, and alcohol mixtures such as those sold by Shell companies under the trade mark "LINEVOL", especially LINEVOL 79 alcohol which is a mixture of $C_{7-9}$ primary alcohols, or a $C_{12-14}$ alcohol mixture which is commercially available).

Dehazers/demulsifiers suitable for use in liquid fuels are well known in the art. Non-limiting examples include glycol oxyalkylate polyol blends (such as sold under the trade designation TOLAD™ 9312), alkoxylated phenol formaldehyde polymers, phenol/formaldehyde or $C_{1-18}$ alkylphenol/-formaldehyde resin oxyalkylates modified by oxyalkylation with $C_{1-18}$ epoxides and diepoxides (such as sold under the trade designation TOLAD™ 9308), and $C_{1-4}$ epoxide copolymers cross-linked with diepoxides, diacids, diesters, diols, diacrylates, dimethacrylates or diisocyanates, and blends thereof. The glycol oxyalkylate polyol blends may be polyols oxyalkylated with $C_{1-4}$ epoxides. The $C_{1-18}$ alkylphenol phenol/formaldehyde resin oxyalkylates modified by oxyalkylation with $C_{1-18}$ epoxides and diepoxides may be based on, for example, cresol, t-butyl phenol, dodecyl phenol or dinonyl phenol, or a mixture of phenols (such as a mixture of t-butyl phenol and nonyl phenol). The dehazer should be used in an amount sufficient to inhibit the hazing that might otherwise occur when the gasoline without the dehazer contacts water, and this amount will be referred to herein as a "haze-inhibiting amount." Generally, this amount is from about 0.1 to about 20 ppmw (e.g. from about 0.1 to about 10 ppm), more preferably from 1 to 15 ppmw, still more preferably from 1 to 10 ppmw, advantageously from 1 to 5 ppmw based on the weight of the gasoline.

Further customary additives for use in gasolines are corrosion inhibitors, for example based on ammonium salts of organic carboxylic acids, said salts tending to form films, or of heterocyclic aromatics for nonferrous metal corrosion protection; antioxidants or stabilizers, for example based on amines such as phenyldiamines, e.g. p-phenylenediamine, N,N'-di-sec-butyl-p-phenyldiamine, dicyclohexylamine or derivatives thereof or of phenols such as 2,4-di-tert-butylphenol or 3,5-di-tert-butyl-4-hydroxy-phenylpropionic acid; anti-static agents; metallocenes such as ferrocene; methylcyclo-pentadienylmanganese tricarbonyl; lubricity additives, such as certain fatty acids, alkenylsuccinic esters, bis(hydroxyalkyl) fatty amines, hydroxyacetamides or castor oil; and also dyes (markers). Amines may also be added, if appropriate, for example as described in WO 03/076554. Optionally anti valve seat recession additives may be used such as sodium or potassium salts of polymeric organic acids.

Diesel Fuel

Diesel fuels according to the present invention include diesel fuels for use in automotive compression ignition engines, as well as in other types of engine such as for example marine, railroad and stationary engines.

The diesel fuel may itself comprise a mixture of two or more different diesel fuel components, and/or be additivated as described below.

Such diesel fuels will contain a diesel base fuel which may typically comprise liquid hydrocarbon middle distillate gas oil(s), for instance petroleum derived gas oils. Such diesel base fuels will typically have boiling points within the usual diesel fuel range of 150 to 400° C., depending on grade and use. They will typically have a density from 750 to 900 kg/m$^3$, preferably from 800 to 860 kg/m$^3$, at 15° C. (e.g. ASTM D4502 or IP 365) and a cetane number (ASTM D613) of from 35 to 80, more preferably from 40 to 75. They will typically have an initial boiling point in the range 150 to 230° C. and a final boiling point in the range 290 to 400° C. Their kinematic viscosity at 40° C. (ASTM D445) might suitably be from 1.5 to 4.5 mm$^2$/s.

Optionally, non-mineral oil based fuels, such as vegetable oil-based or animal fat-based biofuels or Fischer-Tropsch derived fuels, may also form or be present in the diesel fuel. Such Fischer-Tropsch fuels may for example be derived from natural gas, natural gas liquids, petroleum or shale oil, petroleum or shale oil processing residues, coal or biomass.

The amount of Fischer-Tropsch derived fuel used may typically be from 0.5 to 100 percent by volume of the overall diesel fuel, preferably from 5 to 75 percent by volume. It may be desirable for the diesel fuel to contain 10 percent by volume or greater, more preferably 20 percent by volume or greater, still more preferably 30 percent by volume or greater, of the Fischer-Tropsch derived fuel. It is particularly preferred for the diesel fuel to contain 30 to 75 percent by volume, and particularly 30 or 70 percent by volume, of the Fischer-Tropsch derived fuel. The balance of the diesel fuel is made up of one or more other diesel fuel components.

Such a Fischer-Tropsch derived fuel component is any fraction of the middle distillate fuel range, which can be isolated from the (hydrocracked) Fischer-Tropsch synthesis product. Typical fractions will boil in the naphtha, kerosene or gas oil range. Preferably, a Fischer-Tropsch product boiling in the kerosene or gas oil range is used because these products are easier to handle in for example domestic environments. Such products will suitably comprise a fraction larger than 90 wt % which boils between 160 and 400° C., preferably to about 370° C. Examples of Fischer-Tropsch derived kerosene and gas oils are described in EP-A-0583836, WO-A-97/14768, WO-A-97/14769, WO-A-00/11116, WO-A-00/11117, WO-A-01/83406, WO-A-01/83648, WO-A-01/83647, WO-A-01/83641, WO-A-00/20535, WO-A-00/20534, EP-A-1101813, U.S. Pat. Nos. 5,766,274, 5,378,348, 5,888,376 and 6,204,426.

The Fischer-Tropsch product will suitably contain more than 80 wt % and more suitably more than 95 wt % iso and normal paraffins and less than 1 wt % aromatics, the balance being naphthenics compounds. The content of sulphur and nitrogen will be very low and normally below the detection limits for such compounds. For this reason the sulphur content of a diesel fuel containing a Fischer-Tropsch product may be very low.

The diesel fuel preferably contains no more than 5000 ppmw sulphur, preferably, the amount of sulphur in the diesel fuel is no more than, 500 ppmw, 350 ppmw, 150 ppmw, 100 ppmw, 50 ppmw, or 10 ppmw, wherein each value is progressively more preferred.

The diesel base fuel component may itself be additivated (additive-containing) or unadditivated (additive-free). If additivated, e.g. at the refinery, it will contain minor amounts of one or more additives selected for example from anti-static agents, pipeline drag reducers, flow improvers (e.g. ethylene/vinyl acetate copolymers or acrylate/maleic anhydride copolymers), lubricity additives, antioxidants and wax anti-settling agents.

In addition to the reaction product (b) and the detergent additive (c), the diesel fuel composition may contain additional additive components. Examples are lubricity enhancers; dehazers, e.g. alkoxylated phenol formaldehyde polymers; anti-foaming agents (e.g. polyether-modified polysiloxanes); ignition improvers (cetane improvers) (e.g. 2-ethylhexyl nitrate (EHN), cyclohexyl nitrate, di-tert-butyl peroxide and those disclosed in U.S. Pat. No. 4,208,190 at column 2, line 27 to column 3, line 21); anti-rust agents (e.g. a propane-1,2-diol semi-ester of tetrapropenyl succinic acid, or polyhydric alcohol esters of a succinic acid derivative, the succinic acid derivative having on at least one of its alpha-carbon atoms an unsubstituted or substituted aliphatic hydrocarbon group containing from 20 to 500 carbon atoms, e.g. the pentaerythritol diester of polyisobutylene-substituted succinic acid); corrosion inhibitors; reodorants; anti-wear additives; anti-oxidants (e.g. phenolics such as 2,6-di-tert-butylphenol, or phenylenediamines such as N,N'-di-sec-butyl-p-phenylenediamine); metal deactivators; and combustion improvers.

If the diesel base fuel has a low (e.g. 500 ppmw or less) sulphur content, it is preferred that the diesel fuel includes a lubricity enhancer. In the additivated diesel base fuel, the lubricity enhancer is conveniently present at a concentration of less than 1000 ppmw, preferably between 50 and 1000 ppmw, more preferably between 100 and 1000 ppmw. Suitable commercially available lubricity enhancers include ester- and acid-based additives. Other lubricity enhancers are described in the patent literature, in particular in connection with their use in low sulphur content diesel fuels, for example in:

- the paper by Danping Wei and H.A. Spikes, "The Lubricity of Diesel Fuels", Wear, III (1986) 217-235;
- WO-A-95/33805—cold flow improvers to enhance lubricity of low sulphur fuels;
- WO-A-94/17160—certain esters of a carboxylic acid and an alcohol wherein the acid has from 2 to 50 carbon atoms and the alcohol has 1 or more carbon atoms, particularly glycerol monooleate and di-isodecyl adipate, as fuel additives for wear reduction in a diesel engine injection system;
- U.S. Pat. No. 5,490,864—certain dithiophosphoric diester-dialcohols as anti-wear lubricity additives for low sulphur diesel fuels; and
- WO-A-98/01516—certain alkyl aromatic compounds having at least one carboxyl group attached to their aromatic nuclei, to confer anti-wear lubricity effects particularly in low sulphur diesel fuels.

It is also preferred that the diesel fuel composition contains an anti-foaming agent, more preferably in combination with an anti-rust agent and/or a corrosion inhibitor and/or a lubricity additive.

Unless otherwise stated, the (active matter) concentration of each such additives in the diesel fuel composition is preferably up to 1.0 percent by weight, more preferably in the range from 0.1 to 1000 ppmw (e.g. from 5 to 1000 ppmw), advantageously from 0.1 to 300 ppmw (e.g. from 75 to 300 ppmw), such as from 0.1 to 150 ppmw (e.g. from 95 to 150 ppmw).

The (active matter) concentration of any dehazer in the diesel fuel composition will preferably be in the range from about 0.1 to about 20 ppmw (e.g. from about 0.1 to about 10 ppm), more preferably from 1 to 15 ppmw, still more preferably from 1 to 10 ppmw, advantageously from 1 to 5 ppmw. The (active matter) concentration of any ignition improver present will preferably be 2600 ppmw or less, more preferably 2000 ppmw or less, conveniently from 300 to 1500 ppmw.

If desired, the reaction product (b), the detergent additive (c), and any other additive components, as listed above, may be co-mixed, preferably together with suitable diluent(s), in an additive concentrate or additive package, and the additive package may be dispersed into the diesel fuel.

The total content of the additives, other than reaction product (b) and detergent additive (c), in the diesel fuel composition may be suitably between 0 and 1 percent by weight, and is preferably below 5000 ppmw.

Lubricating Oil

Lubricating oil compositions according to the present invention contain a lubricating oil as the base fluid, and are suitable for use as an engine crank case lubricant.

The total amount of lubricating oil incorporated in the lubricating oil composition is at least 60 percent by weight, preferably in the range of from 60 to 92 percent by weight, more preferably in the range of from 75 to 90 percent by weight and most preferably in the range of from 75 to 88 percent by weight, with respect to the total weight of the lubricating oil composition.

There are no particular limitations regarding the lubricating oil used in the lubricating oil composition, and various conventional known mineral oils and synthetic oils may be conveniently used.

The lubricating oil used in the lubricating oil composition may conveniently comprise mixtures of one or more mineral oils and/or one or more synthetic oils.

Mineral oils include liquid petroleum oils and solvent-treated or acid-treated mineral lubricating oil of the paraffinic, naphthenic, or mixed paraffinic/naphthenic type which may be further refined by hydrofinishing processes and/or dewaxing.

Naphthenic lubricating oils have low viscosity index (VI) (generally 40-80) and a low pour point. Such lubricating oils are produced from feedstocks rich in naphthenes and low in wax content and are used mainly for lubricants in which colour and colour stability are important, and VI and oxidation stability are of secondary importance.

Paraffinic lubricating oils have higher VI (generally >95) and a high pour point. Said lubricating oils are produced from feedstocks rich in paraffins, and are used for lubricants in which VI and oxidation stability are important.

Fischer-Tropsch derived lubricating oils may be conveniently used in the lubricating oil composition, for example, the Fischer-Tropsch derived lubricating oils disclosed in EP-A-776959, EP-A-668342, WO-A-97/21788, WO-00/15736, WO-00/14188, WO-00/14187, WO-00/14183, WO-00/14179, WO-00/08115, WO-99/41332, EP-1029029, WO-01/18156 and WO-01/57166.

Synthetic processes enable molecules to be built from simpler substances or to have their structures modified to give the precise properties required.

Synthetic lubricating oils include hydrocarbon oils such as olefin oligomers (PAOs), dibasic acids esters, polyol esters, and dewaxed waxy raffinate. Synthetic hydrocarbon base oils sold by the Royal Dutch/Shell Group of Companies under the designation "XHVI" (trade mark) may be conveniently used.

Preferably, the lubricating oil is constituted from mineral oils and/or synthetic oils which contain more than 80% wt of saturates, preferably more than 90 percent by weight, as measured according to ASTM D2007.

It is further preferred that the lubricating oil contains less than 1.0 percent by weight, preferably less than 0.1 percent by weight of sulphur, calculated as elemental sulphur and measured according to ASTM D2622, ASTM D4294, ASTM D4927 or ASTM D3120.

Preferably, the viscosity index of the lubricating oil, is more than 80, more preferably more than 120, as measured according to ASTM D2270.

Preferably, the lubricating oil has a kinematic viscosity in the range of from 2 to 80 $mm^2/s$ at 100° C., more preferably in the range of from 3 to 70 $mm^2/s$, most preferably in the range of from 4 to 50 $mm^2/s$.

The total amount of phosphorus in the lubricating oil is preferably in the range of from 0.04 to 0.1 percent by weight, more preferably in the range of from 0.04 to 0.09 percent by weight and most preferably in the range of from 0.045 to 0.09 percent by weight, based on total weight of the lubricating oil.

The lubricating oil preferably has a sulphated ash content of not greater than 1.0 percent by weight, more preferably not greater than 0.75 percent by weight and most preferably not greater than 0.7 percent by weight, based on the total weight of the lubricating oil.

The lubricating oil composition preferably has a sulphur content of not greater than 1.2 percent by weight, more preferably not greater than 0.8 percent by weight and most preferably not greater than 0.2 percent by weight, based on the total weight of the lubricating oil lubricating oil composition.

In addition to reaction product (b) and detergent additive (c), the lubricating oil composition may further comprise additives such as anti-oxidants, anti-wear additives, detergents other than detergent additive (c), dispersants, friction modifiers other than those of reaction product (b), viscosity index improvers, pour point depressants, corrosion inhibitors, defoaming agents and seal fix or seal compatibility agents.

Antioxidants that may be conveniently used include those selected from the group of aminic antioxidants and/or phenolic antioxidants.

In a preferred embodiment, said antioxidants are present in an amount in the range of from 0.1 to 5.0 percent by weight, more preferably in an amount in the range of from 0.3 to 3.0 percent by weight, and most preferably in an amount of in the range of from 0.5 to 1.5 percent by weight, based on the total weight of the lubricating oil composition.

The lubricating oil composition may conveniently contain a single zinc dithiophosphate or a combination of two or more zinc dithiophosphates as anti-wear additives, the or each zinc dithiophosphate being selected from zinc dialkyl-, diaryl- or alkylaryl-dithiophosphates.

The lubricating oil composition may generally contain in the range of from 0.4 to 1.0 percent by weight of zinc dithiophosphate, based on total weight of the lubricating oil composition.

Additional or alternative anti-wear additives may be conveniently used in the lubricating oil composition of the present invention.

Suitable alternative anti-wear additives include boron-containing compounds such as borate esters, borated fatty amines, borated epoxides, alkali metal (or mixed alkali or alkaline earth metal) borates and borated overbased metal salts. Said boron-containing anti-wear additives may be conveniently added to the lubricating oil in an amount in the range of from 0.1 to 3.0 percent by weight, based on the total weight of lubricating oil composition.

Typical detergents (other than detergent additive (c)) that may be used in the lubricating oil composition include one or more salicylate and/or phenate and/or sulphonate detergents.

However, as metal organic and inorganic base salts which are used as detergents can contribute to the sulphated ash content of a lubricating oil composition, in a preferred embodiment of the present invention, the amounts of such additives are minimised.

Furthermore, in order to maintain a low sulphur level, salicylate detergents are preferred.

Thus, in a preferred embodiment, the lubricating oil composition may contain one or more salicylate detergents.

In order to maintain the total sulphated ash content of the lubricating oil composition at a level of preferably not greater than 1.0 percent by weight, more preferably at a level of not greater than 0.75 percent by weight and most preferably at a level of not greater than 0.7 percent by weight, based on the total weight of the lubricating oil composition, said detergents are preferably used in amounts in the range of 0.05 to 12.5 percent by weight, more preferably from 1.0 to 9.0 percent by weight and most preferably in the range of from 2.0 to 5.0 percent by weight, based on the total weight of the lubricating oil composition.

Furthermore, it is preferred that said detergents, independently, have a TBN (total base number) value in the range of from 10 to 500 mg·KOH/g, more preferably in the range of from 30 to 350 mg·KOH/g and most preferably in the range of from 50 to 300 mg·KOH/g, as measured by ISO 3771.

The lubricating oil compositions may additionally contain an ash-free dispersant which is preferably admixed in an amount in the range of from 5 to 15 percent by weight, based on the total weight of the lubricating oil composition.

Examples of ash-free dispersants which may be used include the polyalkenyl succinimides and polyalkenyl succinic acid esters disclosed in Japanese Patent Nos. 1367796, 1667140, 1302811 and 1743435. Preferred dispersants include borated succinimides.

Examples of viscosity index improvers which may conveniently used in the lubricating oil composition include the styrene-butadiene copolymers, styrene-isoprene stellate copolymers and the polymethacrylate copolymer and ethylene-propylene copolymers. Such viscosity index improvers may be conveniently employed in an amount in the range of from 1 to 20 percent by weight, based on the total weight of the lubricating oil composition.

Polymethacrylates may be conveniently employed in the lubricating oil compositions as effective pour point depressants.

Furthermore, compounds such as alkenyl succinic acid or ester moieties thereof, benzotriazole-based compounds and thiodiazole-based compounds may be conveniently used in the lubricating oil composition as corrosion inhibitors.

Compounds such as polysiloxanes, dimethyl polycyclohexane and polyacrylates may be conveniently used in the lubricating oil composition as defoaming agents.

Compounds which may be conveniently used in the lubricating oil composition as seal fix or seal compatibility agents include, for example, commercially available aromatic esters.

Detergent Additive (c)

The detergent additive (c) for the functional fluids of the present invention typically have at least one hydrophobic hydrocarbon radical having a number-average molecular weight (Mn) of from 85 to 20 000 and at least one polar moiety selected from:

(A1) mono- or polyamino groups having up to 6 nitrogen atoms, of which at least one nitrogen atom has basic properties;

(A2) nitro groups, if appropriate in combination with hydroxyl groups;

(A3) hydroxyl groups in combination with mono- or polyamino groups, in which at least one nitrogen atom has basic properties;

(A4) carboxyl groups or their alkali metal or their alkaline earth metal salts;

(A5) sulfonic acid groups or their alkali metal or alkaline earth metal salts;

(A6) polyoxy-$C_2$- to -$C_4$-alkylene groups which are terminated by hydroxyl groups, mono- or polyamino groups, in which at least one nitrogen atom has basic properties, or by carbamate groups;

(A7) carboxylic ester groups;

(A8) moieties derived from succinic anhydride and having hydroxyl and/or amino and/or amido and/or imido groups; and/or (A9) moieties obtained by Mannich reaction of substituted phenols with aldehydes and mono- or polyamines.

The hydrophobic hydrocarbon radical in the above detergent additives, which ensures the adequate solubility in the base fluid, has a number-average molecular weight (Mn) of from 85 to 20 000, especially from 113 to 10 000, in particular from 300 to 5000. Typical hydrophobic hydrocarbon radicals, especially in conjunction with the polar moieties (A1), (A3), (A8) and (A9), include polyalkenes (polyolefins), such as the polypropenyl, polybutenyl and polyisobutenyl radicals each having Mn of from 300 to 5000, especially from 500 to 2500, in particular from 700 to 2300.

Non-limiting examples of the above groups of detergent additives include the following:

Additives comprising mono- or polyamino groups (A1) are preferably polyalkenemono- or polyalkenepolyamines based on polypropene or conventional (i.e. having predominantly internal double bonds) polybutene or polyisobutene having Mn of from 300 to 5000. When polybutene or polyisobutene having predominantly internal double bonds (usually in the beta and gamma position) are used as starting materials in the preparation of the additives, a possible preparative route is by chlorination and subsequent amination or by oxidation of the double bond with air or ozone to give the carbonyl or carboxyl compound and subsequent amination under reductive (hydrogenating) conditions. The amines used here for the amination may be, for example, ammonia, monoamines or polyamines, such as dimethylaminopropylamine, ethylenediamine, diethylene-triamine, triethylenetetramine or tetraethylenepentamine. Corresponding additives based on polypropene are described in particular in WO-A-94/24231.

Further preferred additives comprising monoamino groups (A1) are the hydrogenation products of the reaction products of polyisobutenes having an average degree of polymerization of from 5 to 100, with nitrogen oxides or mixtures of nitrogen oxides and oxygen, as described in particular in WO-A-97/03946.

Further preferred additives comprising monoamino groups (A1) are the compounds obtainable from polyisobutene epoxides by reaction with amines and subsequent dehydration and reduction of the amino alcohols, as described in particular in DE-A-196 20 262.

Additives comprising nitro groups (A2), if appropriate in combination with hydroxyl groups, are preferably reaction products of polyisobutenes having an average degree of polymerization of from 5 to 100 or from 10 to 100, with nitrogen oxides or mixtures of nitrogen oxides and oxygen, as described in particular in WO-A-96/03367 and WO-A-96/03479. These reaction products are generally mixtures of pure nitropolyisobutenes (e.g. alpha, beta-dinitropolyisobutene) and mixed hydroxynitropolyisobutenes (e.g. alpha-nitro-beta-hydroxypolyisobutene).

Additives comprising hydroxyl groups in combination with mono- or polyamino groups (A3) are in particular reaction products of polyisobutene epoxides obtainable from polyisobutene having preferably predominantly terminal double bonds and Mn of from 300 to 5000, with ammonia or mono- or polyamines, as described in particular in EP-A-476 485.

Additives comprising carboxyl groups or their alkali metal or alkaline earth metal salts (A4) are preferably copolymers of $C_2$-$C_{40}$-olefins with maleic anhydride which have a total molar mass of from 500 to 20,000 and wherein some or all of the carboxyl groups have been converted to the alkali metal or alkaline earth metal salts and any remainder of the carboxyl groups has been reacted with alcohols or amines. Such additives are disclosed in particular in EP-A-307 815. Such additives serve mainly to prevent valve seat wear and can, as described in WO-A-87/01126, advantageously be used in combination with other detergent additives such as poly(iso)buteneamines or polyetheramines.

Additives comprising sulfonic acid groups or their alkali metal or alkaline earth metal salts (A5) are preferably alkali metal or alkaline earth metal salts of an alkyl sulfosuccinate, as described in particular in EP-A-639 632. Such additives serve mainly to prevent valve seat wear and can be used advantageously in combination other detergent additives such as poly(iso)buteneamines or polyetheramines.

Additives comprising polyoxy-$C_2$-$C_4$-alkylene moieties (A6) are preferably polyethers or polyetheramines which are obtainable by reaction of $C_2$- to $C_{60}$-alkanols, $C_6$- to $C_{30}$-alkanediols, mono- or di-$C_2$-$C_{30}$-alkylamines, $C_1$-$C_{30}$-alkylcyclohexanols or $C_1$-$C_{30}$-alkylphenols with from 1 to 30 mol of ethylene oxide and/or propylene oxide and/or butylene oxide per hydroxyl group or amino group and, in the case of the polyether-amines, by subsequent reductive amination with ammonia, monoamines or polyamines. Such products are described in particular in EP-A-310 875, EP-A-356 725, EP-A-700 985 and U.S. Pat. No. 4,877,416. In the case of polyethers, such products also have carrier oil properties. Typical examples of these are tridecanol butoxylates, isotridecanol butoxylates, isononylphenol butoxylates and polyisobutenol butoxylates and propoxylates and also the corresponding reaction products with ammonia.

Additives comprising carboxylic ester groups (A7) are preferably esters of mono-, di- or tricarboxylic acids with long-chain alkanols or polyols, in particular those having a minimum viscosity of 2 $mm^2/s$ at 100° C., as described in particular in DE-A-38 38 918. The mono-, di- or tricarboxylic acids used may be aliphatic or aromatic acids, and particularly suitable ester alcohols or ester polyols are long-chain representatives having, for example, from 6 to 24 carbon atoms. Typical representatives of the esters are adipates, phthalates, isophthalates, terephthalates and trimellitates of isooctanol, of isononanol, of isodecanol and of isotridecanol. Such products also have carrier oil properties.

Additives comprising moieties derived from succinic anhydride and having hydroxyl and/or amino and/or amido and/or imido groups (A8) are preferably corresponding derivatives of polyisobutenylsuccinic anhydride which are obtainable by reacting conventional or highly reactive polyisobutene having Mn of from 300 to 5000 with maleic anhydride by a thermal route or via the chlorinated polyisobutene. Of particular interest are derivatives with aliphatic polyamines such as ethylenediamine, diethylenetriamine, triethylenetetramine or tetraethylenepentamine. Such additives are described in particular in U.S. Pat. No. 4,849,572.

Additives comprising moieties obtained by Mannich reaction of substituted phenols with aldehydes and mono- or polyamines (A9) are preferably reaction products of polyisobutene-substituted phenols with formaldehyde and mono- or polyamines such as ethylenediamine, diethylenetriamine, triethylenetetramine, tetraethylenepentamine or dimethylaminopropylamine. The polyisobutenyl-substituted phenols may stem from conventional or highly reactive polyisobutene having Mn of from 300 to 5000. Such "polyisobutene-Mannich bases" are described in particular in EP-A-831 141.

Preferably, the detergent additive (c) used in the functional fluids according to the present invention contains at least one nitrogen-containing detergent, more preferably at least one nitrogen-containing detergent containing a hydrophobic hydrocarbon radical having a number average molecular weight in the range of from 300 to 5000. Preferably, the nitrogen-containing detergent is selected from a group comprising polyalkene monoamines, polyalkene Mannich amines and polyalkene succinimides. Conveniently, the nitrogen-containing detergent may be a polyalkene monoamine.

Reaction Product (b)

In a first embodiment of the present invention, the reaction product (b) is a polysubstituted alkanol amine derivative reaction product obtainable by reacting, preferably in a thermal condensation reaction, a carboxylate compound of formula I $$R^1COOR^2 \quad (I)$$

in which:

$R^1$ is an aliphatic $C_{1-30}$-hydrocarbon radical; and $R^2$ is hydrogen or alkyl, mono- or polyhydroxyalkyl, or ammonium, with an alkanol amine of the formula II $$NHR^3R^4 \quad (II)$$

wherein $R^3$ and $R^4$ are independently selected from hydrogen atoms and linear or branched-chain hydrocarbon groups, the carbon chain of which is optionally interrupted by one or more —NH— groups and which optionally has at least one hydroxyl group attached to a carbon atom of the hydrocarbon group, with the proviso that $R^3$ and $R^4$ are not both hydrogen atoms and that at least one of said residues $R^3$ and $R^4$ carries at least one hydroxyl group;

in a molar ratio of the —COO— groups (or carboxyl groups) of the carboxylate compound of formula I to the molar sum of OH and NH groups of the alkanol amine of formula II in a range and under reaction conditions supporting the formation of a reaction product comprising polysubstituted alkanol amine derivatives.

Preferably, said polysubstituted (as for example polycarbonylated) alkanol amine derivatives are comprised in said reaction product in a proportion of more than 20 percent by weight, preferably more than 40 percent by weight, and in particular more than 60 percent by weight, based on the total weight of reaction product (b).

On the other hand 1:1 adducts are present in a total amount of 20 percent by weight or less, more preferred at 15 percent by weight or less and most preferred at a level of 10 percent by weight or less, like about 0.1 to about 10 or about 1 to about 8 or about 1.5 to about 5, about 2 to about 4 percent by weight, based on the total weight of reaction product (b).

According to a preferred embodiment, reaction product (b) is obtained by a process wherein the molar ratio of the —COO— groups of the carboxylate compound of formula I to the molar sum of OH and NH groups of the alkanol amine of formula II is in the range of about 1.8:3 to 3:3, in particular 1.9:3 to 2.5:3.

Preferably, reaction product (b) is formed by a process comprising:

(a') heating a carboxylate compound(s) of formula I (optionally being dissolved or dispersed in a suitable liquid which does not interfere with the reaction) to a first temperature in a first temperature range, allowing the preferential reaction of the acid with amine group(s) of the alkanol amine;

(b') adding thereto an alkanol amine compound(s) of formula II (optionally being dissolved or dispersed in a suitable liquid which does not interfere with the reaction) under controlled conditions in order to avoid an increase of the temperature above said first temperature range;

(c') reacting the compounds by maintaining the temperature in said first temperature range; and (d') increasing the temperature of the reaction mixture to a second temperature in a second temperature range, allowing further condensation of residual free carboxylate compound(s) with any reactive group in the reaction mixture, preferably until the amount of water condensate, or equivalent if the carboxylate is not a carboxylic acid, is at least equal to the theoretical amount of reaction water.

Preferably, the first temperature in step (a'), (b') and/or (c') is kept in the range of about 100 to about 155° C.; e.g. about 110 to about 140° C., or about 120 to about 135° C.

Preferably, the second temperature in step (d') is kept in the range of 160 to 210° C.; e.g. about 170 to about 200° C., or about 175 to about 190° C.

In a particularly preferred embodiment the reaction product (b) is obtained by reacting a carboxylate compound of formula I with an alkanol amine of formula II, wherein $R^3$ and $R^4$ independently of each other represent hydrogen or a residue of the formula III $$—[(CH_2)_xNH]_y(CH_2)_zR^5 \quad (III)$$

wherein x and z are independently from each other integers from 1 to 6, preferably 1, 2, or 3, y is 0 or an integer of 1 to 3, preferably 0 or 1, and $R^5$ is hydroxyl or a residue of the formula IV $$—NH(CH_2)_zOH \quad (IV)$$

wherein z is, independently, as defined above, alternatively, z has the same value as z defined above, with the proviso that $R^3$ and $R^4$ are not both hydrogen atoms.

In a further particularly preferred embodiment, the compound of formula I is selected from $C_{2-31}$-, preferably $C_{8-31}$-, more preferably $C_{8-30}$-, even more preferably $C_{10-22}$-carboxylic acids and alkyl esters thereof.

Preferably the compound of formula II is selected from polyamino alkanols, wherein one of the residues $R^3$ and $R^4$ is hydrogen and the other is a residue of the formula III, wherein x is 2 or 3, y is 0 or 1, z is 2 or 3 and $R^5$ is hydroxyl or a residue of the formula IV.

A "reaction product" as used herein means the product of a specific reaction of at least one carboxylate compound or a carboxylate compound containing first reactant, and at least one alkanol amine or an alkanol amine containing second reactant as explained in more detail below. The reaction product is complex in nature, i.e. consists of a complex mixture of constituents, the profile of which being substantially predetermined by the reaction conditions of said conversion. The reaction product is, as such, a suitable additive for the base fluid and normally need not be further purified prior to use. The product may, however, be concentrated (if necessary) in order to remove residual solvent or low molecular weight constituents (e.g. water), or unreacted reactants, if any.

The term "carboxylate compound" refers to any compound having formula I as defined above.

The term "aliphatic $C_{1-30}$-hydrocarbon radical" denotes an acyclic radical which is composed substantially of carbon atoms and hydrogen atoms and comprises from 1 to 30 carbon atoms, preferably from 8 to 30 carbon atoms. The hydrocarbon radical is preferably an alkyl, alkenyl, alkadienyl, alkatrienyl or polyenyl radical.

Those skilled in the art will appreciate the minimum numbers of carbon atoms that need to be present in hydrocarbon radicals of the various degrees of unsaturation.

An alkyl radical may conveniently be selected from $C_{1-8}$-alkyl radicals which are linear or branched radicals having from 1 to 8 carbon atoms and $C_{8-30}$-alkyl radicals which are linear or branched radicals having from 8 to 30 carbon atoms. Examples of $C_{1-8}$-alkyl radicals are the $C_{1-4}$-alkyl radicals methyl, ethyl, n-propyl, isopropyl, n-butyl, 2-butyl, isobutyl or tert-butyl, and additionally pentyl, 1-methylbutyl, 2-methylbutyl, 3-methylbutyl, 2,2-dimethylpropyl, 1-ethylpropyl, hexyl, 1,1-dimethylpropyl, 1,2-dimethylpropyl, 1-methylpentyl, 2-methylpentyl, 3-methylpentyl, 4-methylpentyl, 1,1-dimethylbutyl, 1,2-dimethylbutyl, 1,3-dimethylbutyl, 2,2-dimethylbutyl, 2,3-dimethylbutyl, 3,3-dimethylbutyl, 1-ethylbutyl, 2-ethylbutyl, 1,1,2-trimethylpropyl, 1,2,2-trimethylpropyl, 1-ethyl-1-methylpropyl, 1-ethyl-2-methylpropyl, heptyl, octyl and their constitutional isomers such as 2-ethylhexyl. Examples of $C_{8-30}$-alkyl radicals are octyl, nonyl, decyl, undecyl, dodecyl, tridecyl, tetradecyl, pentadecyl, hexadecyl, heptadecyl, octadecyl, nonadecyl, eicosyl, hencosyl, docosyl, tricosyl, tetracosyl, pentacosyl, hexacosyl, heptacosyl, octacosyl, nonacosyl, squalyl, their constitutional isomers, higher homologs and constitutional isomers thereof.

An alkenyl radical may conveniently be selected from $C_{2-8}$-alkenyl radicals which are monounsaturated linear or branched hydrocarbon radicals having from 2 to 8 carbon atoms, as for example ethenyl, 1- or 2-propenyl, 1-, 2- and 3-butenyl, 2-methylpropen-3-yl, 2-methylpropen-1-yl, 1-, 2-, 3- and 4-pentenyl, 1-, 2-, 3-, 4- and 5-hexenyl, 1-, 2-, 3-, 4-, 5- and 6-heptenyl 1-, 2-, 3-, 4-, 5-, 6- and 7-octenyl and also their constitutional isomers; and $C_{8-30}$-alkenyl radicals which are monounsaturated linear or branched hydrocarbon radical having from 8 to 30 carbon atoms, as for example octenyl, nonenyl, decenyl, undecenyl, dodecenyl, tridecenyl, tetradecenyl, pentadecenyl, hexadecenyl, heptadecenyl, octadecenyl, nonadecenyl, eicosenyl, hencosenyl, docosenyl, tricosenyl, tetracosenyl, pentacosenyl, hexacosenyl, heptacosenyl, octacosenyl, nonacosenyl, squalenyl, their constitutional isomers, higher homologs and constitutional isomers thereof.

An alkandienyl radical may conveniently be selected from $C_{4-8}$-alkadienyl radicals which are diunsaturated linear or branched hydrocarbon radicals having from 4 to 8 carbon atoms, as for example butadienyl, pentadienyl, hexadienyl, heptadienyl or octadienyl and their constitutional isomers; and $C_{8-30}$-alkadienyl radicals which are diunsaturated linear or branched hydrocarbon radicals having from 8 to 30 carbon atoms, as for example octadienyl, nonadienyl, decadienyl, undecadienyl, dodecadienyl, tridecadienyl, tetradecadienyl, pentadecadienyl, hexadecadienyl, heptadecadienyl, octadecadienyl, nonadecadienyl, eicosadienyl, hencosadienyl, docosadienyl, tricosadienyl, tetracosadienyl, pentacosadienyl, hexacosadienyl, heptacosadienyl, octacosadienyl, nonacosadienyl, squaladienyl, their constitutional isomers, higher homologs and constitutional isomers thereof. The olefinic double bonds may be present in conjugated or isolated form.

An alkantrienyl radical may conveniently be selected from $C_{6-8}$-alkatrienyl radicals which are tri-unsaturated linear or branched hydrocarbon radical having from 6 to 8 carbon atoms, as for example hexatrienyl, heptatrienly or octatrienyl; and $C_{8-30}$-alkatrienyl radicals, which are triunsaturated linear or branched hydrocarbon radicals having from 8 to 30 carbon atoms, as for example octatrienyl, nonatrienyl, decatrienyl, undecatrienyl, dodecatrienyl, tridecatrienyl, tetradecatrienyl, pentadecatrienyl, hexadecatrienyl, heptadecatrienyl, octadecatrienyl, nonadecatrienyl, eicosatrienyl, hencosatrienyl, docosatrienyl, tricosatrienyl, tetracosatrienyl, pentacosatrienyl, hexacosatrienyl, heptacosatrienyl, octacosatrienyl, nonacosatrienyl, squalatrienyl, their constitutional isomers, higher homologs and constitutional isomers thereof. The olefinic double bonds may be present in conjugated or isolated form.

A polyenyl radical is generally an unsaturated linear or branched aliphatic hydrocarbon radical, preferably having from 8 to 30 carbon atoms, and four, five, six or more olefinic nonvicinal double bonds. Examples thereof are the higher unsaturated analogs of the above alkadi- and trienyl radicals.

When $R^2$ represents an alkyl group, it is preferably a $C_{1-8}$-alkyl group, which is a linear or branched alkyl radical having from 1 to 8 carbon atoms. Examples thereof are the $C_{1-4}$-alkyl radicals methyl, ethyl, n-propyl, isopropyl, n-butyl, 2-butyl, isobutyl or tert-butyl, and additionally pentyl, 1-methylbutyl, 2-methylbutyl, 3-methylbutyl, 2,2-dimethylpropyl, 1-ethylpropyl, hexyl, 1,1-dimethylpropyl, 1,2-dimethylpropyl, 1-methylpentyl, 2-methylpentyl, 3-methylpentyl, 4-methylpentyl, 1,1-dimethylbutyl, 1,2-dimethylbutyl, 1,3-dimethylbutyl, 2,2-dimethylbutyl, 2,3-dimethylbutyl, 3,3-dimethylbutyl, 1-ethylbutyl, 2-ethylbutyl, 1,1,2-trimethylpropyl, 1,2,2-trimethylpropyl, 1-ethyl-1-methylpropyl, 1-ethyl-2-methylpropyl, heptyl, octyl and their constitutional isomers such as 2-ethylhexyl.

When $R^2$ represents a mono- or polyhydroxyalkyl group, it is preferably a $C_{1-8}$-mono- or poly-hydroxyalkyl group, which is a linear or branched alkyl radical having from 1 to 8, more preferably from 1 to 4 carbon atoms, in which at least one hydrogen atom, for example 1, 2, 3, or 4 of the hydrogen atoms, is/are replaced by a hydroxyl group. Examples thereof are, hydroxymethyl, 2-hydroxy-1-ethyl, 2- and 3-hydroxy-1-propyl, 2-, 3- and 4-hydroxy-1-butyl, 2-, 3-, 4- and 5-hydroxy-1-pentyl, 2-, 3-, 4-, 5- and 6-hydroxy-1-hexyl, 2-, 3-, 4-, 5-, 6- and 7-hydroxy-1-heptyl, 2-, 3-, 4-, 5-, 6-, 7- and 8-hydroxy-1-octyl, 2,3-dihydroxy-1-propyl and their constitutional isomers. If $R^2$ represents a polyhydroxyalkyl residue, said hydroxyl groups are, preferably, not further esterfied. In particular, compounds of formula I do not comprise polyol polyester, as for example tri-glycerides.

In the above definition, a hydroxyalkyl group is preferably a $C_{1-8}$-hydroxyalkyl group, which is a linear or branched alkyl radical having from 1 to 8, in particular from 1 to 4 carbon atoms, in which one hydrogen atom is replaced by a hydroxyl group. Suitable examples are stated above.

A "linear or branched-chain hydrocarbon group, the carbon chain of which is optionally interrupted by one or more —NH— groups and which optionally has at least one hydroxyl group attached to a carbon atom of the hydrocarbon group", is selected from: a linear or branched hydrocarbon group, for example an alkyl, alkenyl, alkadienyl, alkatrienyl, or polyenyl radical; a linear or branched mono- or polyhydroxyalkyl group, for example a mono- or polyhydroxyalkyl group as defined in relation to the $R^2$ group above; two or more $C_{1-6}$-alkylene groups linked together by a —NH— group, wherein one of the $C_{1-6}$-alkylene groups contains a terminal hydrogen atom; and, two or more $C_{1-6}$-alkylene groups linked together by a —NH— group, wherein at least one of the $C_{1-6}$-alkylene groups is substituted by 1 or more hydroxyl groups, for example 1, 2, or 3 hydroxyl groups, and one of the $C_{1-6}$-alkylene groups contains a terminal group selected from a hydrogen atom or a hydroxyl group. If any of the above groups contain a hydroxyl group, preferably the hydroxyl group is a terminal hydroxyl group.

In the preceding paragraph, "$C_{1-6}$-alkylene" is a linear or branched bridging hydrocarbon group having up to 6 carbon atoms, preferably 2, 3, 4, 5 or 6 carbon atoms, for example 1,2-ethylene, 1,2- and 1,3-propylene, 1,2-, 1,3-, 2,3- and 1,4-butylene, 2,2-dimethyl-1,2-ethylene, 1,1-dimethyl-1,2-ethylene, 1,5-pentylene, 1,6-hexylene and constitutional isomers thereof.

A "polysubstituted" or "polycarbonylated" alkanol amine derivative is derived from an polyfunctional alkanol amine, as for example an alkanol polyamine, wherein more than one functional groups (—NH— or —OH groups) of which, being substituted by a carbonyl residue of the formula —CO(hycrocarbyl), wherein hydrocarbyl has the same meanings as an "aliphatic $C_{1-30}$-hydrocarbon radical" as already defined above. In particular said substituents may be derived from same or different $C_{10-22}$-carboxylic acids. The term "polysubstituted" alkanol amine derivatives explicitly includes all disubstituted, trisubstituted, tetrasubstituted, and higher substituted alkanol amine derivatives.

Carboxylate compounds of formula I, and in particular $C_{2-31}$-carboxylic acids, as for example $C_{8-30}$-carboxylic acids, and alkyl esters thereof, are compounds of formula I wherein the $R^1$ group is an aliphatic $C_{1-30}$-hydrocarbon radical, as for example an aliphatic $C_{7-29}$-hydrocarbon radical. For example, the $R^1$ group may be selected from: linear alkyl radicals; branched alkyl radicals; linear, mono- or poly-unsaturated hydrocarbon radicals; or, mixtures of such radicals, having an average of from 1-30, preferably from 1-29, more preferably 5-25 carbon atoms. Particularly preferred hydrocarbon radicals are:

linear alkyl radicals: $CH_3$—; $C_2H_5$—; $C_3H_7$—; $C_4H_9$—; $C_5H_{11}$—; $C_6H_{13}$—; $C_7H_{15}$—, $C_8H_{17}$—; $C_9H_{19}$—; $C_{10}H_{21}$—; $C_{11}H_{23}$—; $C_{12}H_{25}$—; $C_{13}H_{27}$—; $C_{14}H_{29}$—; $C_{15}H_{31}$—; $C_{16}H_{33}$—; $C_{17}H_{35}$—; $C_{18}H_{37}$—; $C_{19}H_{39}$—; $C_{20}H_{41}$—; $C_{21}H_{43}$—; $C_{23}H_{47}$—; $C_{24}H_{49}$—; —$C_{25}H_{51}$—; $C_{29}H_{59}$—; $C_{30}H_{61}$—;

branched alkyl radicals: iso-$C_3H_7$—; iso-$C_4H_9$—; iso-$C_{18}H_{37}$—;

linear alkenyl radicals: $C_2H_3$—; $C_3H_5$—; $C_{15}H_{29}$—; $C_{17}H_{33}$—; $C_{21}H_{41}$—;

linear alkadienyl radicals: $C_5H_7$—; $C_{17}H_{31}$—;

linear alkatrienyl radicals: $C_{17}H_{29}$—;

four-fold unsaturated, linear polyenyl radicals: $C_{19}H_{31}$—;

five-fold unsaturated, linear polyenyl radicals: $C_{21}H_{33}$—.

Conveniently, said carboxylate compounds of formula I, and in particular carboxylic acid, or ester thereof, may also be derived from fatty acid mixtures as obtained from naturally occurring oils and fats. Non-limiting examples thereof are olive oil, palm oil, palm cernel oil, peanut oil, rapeseed oil, safflower oil, sesame oil, sunflower oil, soy bean oil, beef tallow oil, lard oil, castor oil, cottonseed oil, corn oil, soybean oil, whale oil, and coconut oil. As examples of suitable fatty acids there may be mentioned monocarboxylic acids such as capric, lauric, myristic, palmitic, stearic, behenic, oleic, petroselinic, elaidic, palmitoleic, linoleic, linolenic and erucic acid.

The alkanol amine of formula II may be a monoalkanolamine, a dialkanolamine, or a polyalkanolamine. The alkanolamine can possess one or more additional O and/or N functionalities in addition to the one amino group, and must contain at least one hydroxyl group. Suitable alkanolamines include monoethanolamine, diethanolamine, propanolamine, isopropanolamine, dipropanolamine, di-isopropanolamine, butanolamines, and polyaminoalkanols like aminoethylaminoethanols, e.g., 2-(2-aminoethylamino)ethanol (AEAE).

Alkanol amines include, for example, compounds of formula II wherein at least one of the residues $R^3$ and $R^4$ represents —$[(CH_2)_xNH]_y(CH_2)_zR^5$, wherein $R^5$ is hydroxyl or $NH(CH_2)_zOH$. Suitable examples of groups of the formula —$[(CH_2)_xNH]_y(CH_2)_z$— are:

$C_2H_4$—$NH_nC_2H_4$;

$CH_2)_3$—$NH_n(CH_2)_3$—;

$CH_2$—$CH(CH_3)$—$NH_nCH_2$—$CH(CH_3)$—;

$CH(CH_3)$—$CH_2$—$NH_nCH(CH_3)$—$CH_2$—; and $CH_2)_4$—$NH_n(CH_2)_4$—, wherein n is 0, 1 or 2.

In one particular group of alkanol amines, one of $R^3$ or $R^4$ groups of the compounds of formula II represents a hydrogen, and the other $R^3$ or $R^4$ group is represented by the formula —$[(CH_2)_xNH]_y(CH_2)_zR^5$, wherein $R^5$ is hydroxyl and the group of the formula —$[(CH_2)_xNH]_y(CH_2)_z$ is selected from $C_2H_4$—$NH_nC_2H_4$, $CH_2)_3$—$NH_n(CH_2)_3$—, $CH_2$—$CH(CH_3)$—$NH_nCH_2$—$CH(CH_3)$—, $CH(CH_3)$—$CH_2$—$NH_nCH(CH_3)$—$CH_2$—, $CH_2)_4$—$NH_n(CH_2)_4$—, wherein n is 1 or 2.

Examples of Reaction Products

In a non-limiting example of the present invention, the reaction product (b) may represent a complex product mixture, which is characterized by a high proportion of polysubstituted, i.e. at least two-fold substituted, alkanol polyamines (or polyaminoalkanols). In particular, the reaction mixture is characterized by a high proportion of constituents, which are selectively carbonylated at primary and/or secondary amino groups.

Preferably, such reaction products are obtainable by reaction of an alkanol amine selected from the above-identified group of specific alkanol amines with a carboxylate compound containing reagent under conditions defined herein.

Taking 2-(2-aminoethylamino)ethanol (AEAE) as the reactant of formula II, when a molar excess of a fatty acid is used, the reaction product formed may contain main constituents A, B and C (as depicted below), which are: the main diamide product (A), optionally in admixture with the corresponding (analytically difficult to distinguish) monoamidoester, each of which carrying two carbonyl residues; the fully substituted diamidoester (B) carrying three carbonyl groups; and the monoamide (C). The reaction mixture may also contain minor amounts of unreacted oleic acid (D) (1-5%) and AEAE (<0.1%) as well as significant amounts (10-20%) of unidentified by-products (it is presumed that, inter alia, pyrazidins, imidazolins and ethers are produced). The kinetically controlled first step of the reaction, performed at about 130° C., favours the formation of the main component, in particular the diamide (A), while the less specific reaction conditions in the second reaction step, at about 180° C., result in the formation of the diamidoester (B).

A

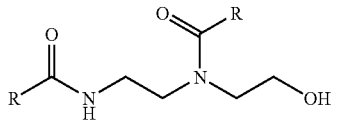

30-60%

B

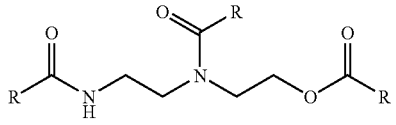

10-40%

C

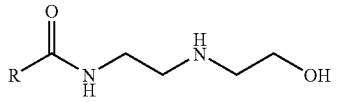

<10%

D

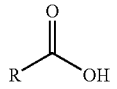

1-5%

+ 10-20% further so far not identified components

It will be understood by a skilled reader that the specific conditions exemplified herein may be changed without changing the general teaching of the present invention. For example, it is possible to change the order of adding reactants to the reaction mixture, to pre-heat the reactants, if necessary, to add one or more solvents which may be removed after the end of the reaction. In addition it may be possible to remove, if necessary the water, or equivalent condensation by-product, formed during the course of the condensation reaction. Any catalyst known in the art as being suitable for use in the above condensation reaction may also be used.

Any suitable solvent which does not negatively affect the conversion reaction may be used. If a solvent is used, said solvent is preferably compatible with the other constituents of an additive concentrate (additive package) or the base fluid to which the reaction product (b) is to be added, so that it is not necessary to remove the solvent prior to use. Examples of suitable solvents include toluene, xylene or any other aromatic solvent; dioxane, dialkyl glycol and dialkyl oligo glycols.

Functional Fluid

The reaction product (b) may be added to the functional fluid as a friction modifier, lubricity additive, detergent or deposit control additive, acceleration improver, or corrosion inhibitor. Therefore, the present invention provides a functional fluid comprising a major amount of a base fluid as described herein and a minor amount of the reaction product (b) as described herein.

Advantageously, it has been found that a combination of the reaction product (b) and the detergent additive (c) can lead to a surprising improvement in the performance of the reaction product (b). Therefore, the present invention provides a functional fluid comprising a major amount of a base fluid as described herein, a minor amount of the reaction product (b) as described herein, and a minor amount of detergent additive (c).

The reaction product (b) and the detergent additive (c) may be added to the base fluid either individually or together, in an additive concentrate (additive package), as a mixture with one or more further additive components (co-additives). The co-additives may be any additive components known for use in gasoline, diesel fuel or lubricating oil.

It is particularly preferred that the reaction product (b) and the detergent additive (c) are contained in an additive concentrate; more preferably, the additive concentrate contains the reaction product (b) and the detergent additive (c) in a suitable organic solvent. Conveniently, such an additive concentrate comprises the reaction product (b) and at least one detergent additive selected from a group comprising polyalkene monoamines, polyalkene Mannich amines and polyalkene succinimides, in a suitable organic solvent.

When the base fluid is a fuel, such as a gasoline or diesel fuel, the reaction product (b), the detergent additive (c), and any co-additive (such as the additives described in relation to gasoline and diesel fuel compositions) may be added to the base fluid as an additive concentrate, comprising a mixture of additives and carrier oils and/or solvents as discussed above. Typically, such additive concentrates may contain:

- reaction product (b): in proportions of about 5-80 or about 10-70 or about 10-40 percent by weight, based on the total weight of the concentrate;
- detergent(s): in proportions of about 10-80 or about 20-70 or about 30-70 percent by weight, based on the total weight of the concentrate;
- carrier oil(s): in proportions of about 5-70 or about 10-50 or about 10-40 percent by weight, based on the total weight of the concentrate;
- solvent(s): in proportions of about 5-70 or about 5-50 or about 10-50 percent by weight, based on the total weight of the concentrate;
- co-solvent(s): in proportions of about 1-40 or about 5-30 or about 5-20 percent by weight, based on the total weight of the concentrate;
- optionally: dehazer(s) (about <1%), corrosion inhibitor(s) (about 0, 1-5%), conductivity improvers (about <2%), each based on the total weight of the concentrate; and others.

The amount of reaction product (b) in the functional fluid of the present invention is conveniently in the range of from 1 parts per million by weight (ppmw) to 50,000 ppmw (5 percent by weight), more conveniently in the range of from 5 to 20,000 ppmw.

If the functional fluid is a fuel, such as a gasoline composition or a diesel fuel composition, the amount of reaction product (b) in the functional fluid is preferably in the range of from 1 parts per million by weight (ppmw) to 5,000 ppmw, more preferably in the range of from 5 to 2,000 ppmw, in particular from 10 to 1,500 ppmw, and especially from 10 to 500 ppmw.

If the functional fluid is a lubricating oil composition, the amount of reaction product (b) in the functional fluid is preferably in the range of from 1 parts per million by weight (ppmw) to 50,000 ppmw, more preferably in the range of from 10 to 40,000 ppmw, in particular from 50 to 25,000, and especially from 100 to 20,000 ppmw.

The amount of the detergent additive (c) in the functional fluid of the present invention is conveniently in the range of from 1 parts per million by weight (ppmw) to 50,000 ppmw (5 percent by weight), more conveniently in the range of from 5 to 20,000 ppmw.

If the functional fluid is a fuel composition, such as a gasoline composition or a diesel fuel composition, the amount of the detergent additive (c) in the functional fluid is preferably in the range of from 1 parts per million by weight (ppmw) to 5,000 ppmw, more preferably in the range of from 5 to 2,000 ppmw, in particular from 10 to 1,500 ppmw, and especially from 10 to 500 ppmw.

If the functional fluid is a lubricating oil composition, the amount of the detergent additive (c) in the functional fluid is preferably in the range of from 1 parts per million by weight (ppmw) to 50,000 ppmw, more preferably in the range of from 10 to 40,000 ppmw, in particular from 50 to 25,000, and especially from 100 to 20,000 ppmw.

The ratio (either molar or weight) of the reaction product (b) and the detergent additive (c) is not though to be critical. Typically, the molar ratio the reaction product (b) to the detergent additive (c) will be in the range of from about 20:1 to 1:20, for instance from about 10:1 to 1:10 or even from about 5:1 to 1:5. For instance, the ratio of the reaction product (b) to the detergent additive (c) can range from having a majority of the reaction product (b) to having a majority of the detergent additive (c). For instance the functional fluid could have a molar ratio of at most 20:1, 15:1, 10:1, 8:1, 7:1, 6:1, 5:1, 4:1, 3:1, or even 2:1, of reaction product (b) to detergent additive (c); a molar ratio of at most 20:1, 15:1, 10:1, 8:1, 7:1, 6:1, 5:1, 4:1, 3:1, or even 2:1, of detergent additive (c) to reaction product (b); or any combination thereof.

The functional fluids of the present invention may be prepared by bringing into admixture the reaction product (b) and the detergent additive (c) with the base fluid. Conveniently, the reaction product (b) and the detergent additive (c) may be incorporated into an additive concentrate containing at least one additional additive and optionally a carrier oil and/or solvent, and said additive concentrate may be blended with the base fluid.

The functional fluids of the present invention may be used to provide benefits in terms of improved fuel economy of the internal combustion engine, increased lubricity, together with improved engine start-up times, whilst exhibiting no negative effects with respect to valve stick during operation.

In a particular, benefits in terms of improved fuel economy and improved engine start-up times have been observed in several spark-ignition engines fuelled by gasolines containing reaction product (b), and benefits in terms of improved fuel economy have been observed in a spark-ignition engine using a lubricating oil containing reaction product (b) for lubricating the engine. Additionally, it has been observed that gasoline containing reaction product (b) provides benefits in terms of improved lubricity and further improvements in lubricity have been observed when the gasoline additionally contains detergent additive (c).

The present invention further provides a method of operating an internal combustion engine, which method involves introducing into a combustion chamber of the engine a functional fluid comprising a fuel as the base fluid.

For example, when the functional fluid is a gasoline composition, the present invention provides a method of operating a spark-ignition internal combustion engine, which method involves introducing into a combustion chamber of the engine a gasoline composition according to the present invention; and, when the functional fluid is a diesel fuel composition, the present invention provides a method of operating a compression-ignition internal combustion engine, which method involves introducing into a combustion chamber of the engine a diesel fuel composition according to the present invention.

When the functional fluid is a lubricating oil composition, the present invention yet further provides a method of operating an internal combustion engine, which method involves using a lubricating oil composition according to the present invention as a lubricant for the engine, in particular as an engine crank case lubricant.

The invention will be understood from the following illustrative examples, in which, unless otherwise indicated, parts and percentages are by weight, and temperatures are in degrees Celsius.

EXAMPLES

Comparative Example A

Reaction Product of Coconut Oil Methyl Ester and Diethanol Amine (Molar Ratio: 1:1)

A 5 L four-neck glass reactor equipped with condenser, automatic injection equipment, internal temperature control and anchor stirrer was charged with 2200 g of coconut methyl ester (technical grade: ester content, % (m/m): 96.5 min, kinematic viscosity at 40° C., mm2/s: 2.0-4.5) and heated to 150° C. 1050 g of diethanol amine was added at this temperature within 30 minutes. The reaction mixture was kept at 150° C. for 4 hours, and than heated up for 1 hour to 160° C. to completely remove residual methanol. The resulting product was yellow oil.

Example 1

Reaction Product of Coconut Oil Methyl Ester and Diethanol Amine (Molar Ratio: 2:1)

According to procedure of comparative example A, 3000 g of coconut methyl ester (technical grade: ester content, % (m/m): 96.5 min, kinematic viscosity at 40° C., mm2/s: 2.0-4.5) and 716 g diethanol amine were reacted to a yellow oil.

Example 2

Reaction Product of Coconut Oil Methyl Ester and Diethanol Amine (Molar Ratio: 3:1)

According to procedure of comparative example A, 3000 g of coconut methyl ester (technical grade: ester content, % (m/m): 96.5 min, kinematic viscosity at 40° C., mm2/s: 2.0-4.5) and 477 g diethanol amine were reacted to a yellow oil.

Comparative Example B

Reaction Product of Oleic Acid and AEAE (Molar Ratio: 1:1)

A 250 ml glass flask equipped with a condenser was charged with 56.4 g of oleic acid (approx. 0.2 moles) and heated up to 130° C. At this temperature 20.8 g (0.2 moles) of amino ethyl ethanolamine were added within 10 minutes. After stirring for three hours at this temperature the reaction mixture was heated up to 180° C. and kept at this temperature for 5 hours. 66 g of brown oil was yielded which solidified after few hours to a light brown wax. Amine number was 124 mgKOH/g.

Example 3

Reaction Product of Oleic Acid and AEAE (Molar Ratio: 2:1)

Oleic acid and amino ethyl ethanolamine were reacted as described in comparative example B but in a molar ratio of 2:1. Resulting product was a light brown wax with an amine number of 14 mgKOH/g.

Example 4

Reaction Product of Oleic Acid and AEAE (Molar Ratio: 3:1)

Oleic acid and amino ethyl ethanolamine were reacted as described in comparative example B but in a molar ratio of 3:1. Resulting product was brown oil with an amine number of 6.2 mgKOH/g.

Example 5

To demonstrate the effect of different molar ratios, three different products (prepared according to Comparative Example B, and Examples 3 and 4) were blended with polyisobutene amine (PIBA), a commercially available polyoxyalkylene carrier oil and different amounts of solvent to result in typical fuel additive compositions.

The storage stability at low temperature and the tendency to stabilize emulsions were examined. Standard test procedures were applied. The results are summarized in the following Table 1.

TABLE 1

Test Results

| | Dose [mg/kg] | PIBA | PE | Comp Ex. B 1:1[1)] 1:3[2)] | Ex. 3 2:1[1)] 2:3[2)] | Ex. 4 3:1[1)] 3:3[2)] | SNH | 2-PH | ASTM D 1094 5 min. | ASTM D 1094, 5 min. + 1 ppm Dehazer[3)] | Visual assessment after storage at −20° C. for 7 days |
|---|---|---|---|---|---|---|---|---|---|---|---|
| mod1 | 1150 | 250 | 200 | 100 | | | 300 | 300 | 4/3[4)] | 2/3 | Precipitation |
| mod2 | 1150 | 250 | 200 | | 100 | | 300 | 300 | 4/2 | 0/1 | Clear liquid |
| mod3 | 1150 | 250 | 200 | | | 100 | 300 | 300 | 2/1 | 0/1 | Clear liquid |
| mod4 | 1000 | 250 | 200 | 100 | | | 150 | 300 | | | Solid |
| mod5 | 1000 | 250 | 200 | | 100 | | 150 | 300 | | | Clear liquid |
| mod6 | 1000 | 250 | 200 | | | 100 | 150 | 300 | | | Clear liquid |
| mod7 | 850 | 250 | 200 | 100 | | | 150 | 150 | | | Solid |
| mod8 | 850 | 250 | 200 | | 100 | | 150 | 150 | | | Precipitation |
| mod9 | 850 | 250 | 200 | | | 100 | 150 | 150 | | | Turbidity |

[1)]molar ratio of fatty acid and alkanol amide reactants
[2)]molar ratio of functional groups of fatty acid and alkanol amide reactants
[3)]Dehazer: commercial product containing oxalkylated polymers
SNH = Solvent Naphta heavy
2-PH = 2-Propylheptanol
[4)]Rating scale according ASTM D 1094 interface/separation This clearly demonstrates that product of Example 4 requires less solubilizer to achieve stable formulations. At the same time products of Examples 3 and 4 are less critical in the ASTM D 1094 test.

Example 6

Gasoline Lubricity

In order to assess the lubricity of gasoline compositions according to the present invention, the series of fuels detailed in Table 2 below were prepared.

TABLE 2

Test Fuels for Lubricity

| Fuel | Reaction Product (b) | Detergent |
|---|---|---|
| Base Fuel | 0 ppmw | 0 ppmw |
| Test Fuel 1 | 100 ppmw | 0 ppmw |
| Test Fuel 2 | 0 ppmw | 200 ppmw |
| Test Fuel 3 | 100 ppmw | 200 ppmw |

The base fuel composition used was a gasoline composition having the parameters detailed in Table 3 below:

TABLE 3

Base Fuel

| Parameter | Method | Units | |
|---|---|---|---|
| RON | ASTM D2699 | | 95.3 |
| MON | ASTM D2700 | | 87.3 |
| Density @ 15° C. | IP 365 | g cm$^{-3}$ | 0.7313 |
| IBP | IP 123 | ° C. | 35.3 |
| 10% recovery | IP 123 | ° C. | 53.0 |
| 20% recovery | IP 123 | ° C. | 60.9 |
| 30% recovery | IP 123 | ° C. | 69.1 |
| 40% recovery | IP 123 | ° C. | 79.0 |
| 50% recovery | IP 123 | ° C. | 91.1 |
| 60% recovery | IP 123 | ° C. | 104.3 |
| 70% recovery | IP 123 | ° C. | 116.5 |
| 80% recovery | IP 123 | ° C. | 127.8 |
| 90% recovery | IP 123 | ° C. | 140.2 |
| 95% recovery | IP 123 | ° C. | 147.5 |
| FBP | IP 123 | ° C. | 169.5 |
| Sulphur content | ISO 20884 | mg/kg | 7 |
| RVP | IP 394/ASTM 5191 | kPa. | 54.9 |

The "Reaction Product (b)" used in Test Fuels 1 and 3 was a reaction product of oleic acid and 2-(2-aminoethylamino) ethanol (AEAE), prepared in a manner similar to that described in example 4.

The detergent used in Test Fuels 2 and 3 was a polyisobutylene monoamine (PIBA) ex BASF, in which the polyisobutylene (PIB) chain has a number average molecular weight of approximately 1000.

The lubricity of the gasoline compositions was determined by using a modified HFRR (high frequency reciprocating rig) test. The modified HFRR test is based on ISO 12156-1 using a PCS Instruments HFRR supplemented with the PCS Instruments Gasoline Conversion Kit, and using a fluid volume of 15.0 ml (+/−0.2 ml), a fluid temperature of 25.0° C. (+/−1° C.), and wherein a PTFE cover is used to cover the test sample in order to minimise evaporation. The results recorded in Table 4 below shows the average recorded wear scar.

TABLE 4

HFRR Wear Scar Results

| Fuel | Average Wear Scar (μm) |
|---|---|
| Base Fuel | 882 |
| Test Fuel 1 | 422 |
| Test Fuel 2 | 922.5 |
| Test Fuel 3 | 353 |

As can be seen from the results in Table 4, a reduced wear scar is observed in the HFRR test for the gasoline compositions containing the reaction product (b), Test Fuel 1, compared to the base fuel, which represents an improvement in lubricity of the fuel compared to the base fuel. Surprisingly, in spite of the fact that the result for Test Fuel 2 shows an increase in wear scar compared to the base fuel, the HFRR result for Test Fuel 3, which contains both the reaction product (b) and a detergent additive, shows that the wear scar is significantly reduced.

We claim:

1. A functional fluid suitable for use in an internal combustion engine, comprising:

(a) a major amount of a base fluid;

(b) a minor amount of a polysubstituted alkanol amine derivative reaction product produced by a process reacting:

(i) a carboxylate compound of formula I $$R^1COOR^2 \quad (I)$$

in which:

$R^1$ is an aliphatic $C_{1-30}$-hydrocarbon radical; and $R^2$ is hydrogen or alkyl, mono- or polyhydroxyalkyl, or ammonium; with (ii) an alkanol amine of the formula II $$NHR^3R^4 \quad (II)$$

wherein $R^3$ and $R^4$ are independently selected from hydrogen atoms and linear or branched-chain hydrocarbon groups, the carbon chain of which is optionally interrupted by one or more —NH— groups and which optionally has at least one hydroxyl group attached to a carbon atom of the hydrocarbon group, with the proviso that $R^3$ and $R^4$ are not both hydrogen atoms and that at least one of said residues $R^3$ and $R^4$ carries at least one hydroxyl group;

wherein said process comprises a molar ratio of the —COO— groups of the carboxylate compound of formula I to the molar sum of —OH and —NH— groups of the alkanol amine of formula II in a range and under at least one reaction condition effective to form the reaction product comprising polysubstituted alkanol amine derivatives; and (c) a minor amount of a detergent additive.

2. The functional fluid of claim 1 wherein the reaction product (b) comprises said polysubstituted alkanol amine derivatives in an amount of more than 20 wt. % based on the total weight of reaction product (b).

3. The functional fluid of claim 1 wherein $R^3$ and $R^4$ independently of each other represent hydrogen or a residue of the formula III $$—[(CH_2)_xNH]_y(CH_2)_zR^5 \quad (III)$$

wherein x and z are independently from each other integers from 1 to 6, y is 0 or an integer of 1 to 3 and $R^5$ is hydroxyl or a residue of the formula IV $$—NH(CH_2)_zOH \quad (IV)$$

wherein z is, independently, as defined above, with the proviso that $R^3$ and $R^4$ are not both hydrogen atoms.

4. The functional fluid of claim 1 wherein $R^1$ of the carboxylate compound of formula I is an aliphatic $C_{8-30}$-hydrocarbon radical.

5. The functional fluid of claim 1 wherein the compound of formula II is selected from polyaminoalkanols, wherein one of the residues $R^3$ and $R^4$ is hydrogen and the other is a residue of the formula III, wherein x is 2 or 3, y is 0 or 1, z is 2 or 3 and $R^5$ is hydroxyl or a residue of the formula IV.

6. The functional fluid of claim 1 wherein the detergent additive (c) contains at least one nitrogen-containing detergent containing a hydrophobic hydrocarbon radical having a number average molecular weight in the range of from 300 to 5000.

7. The functional fluid of claim 6 wherein the nitrogen-containing detergent is selected from a group comprising polyalkene monoamines, polyalkene Mannich amines and polyalkene succinimides.

8. The functional fluid of claim 7 wherein the nitrogen-containing detergent is a polyalkene monoamine.

9. The functional fluid of claim 1 wherein the base fluid is a gasoline.

10. The functional fluid of claim 1 wherein the base fluid is a diesel fuel.

11. The functional fluid of claim 9 wherein the reaction product (b) is present in an amount in the range of from 1 parts per million by weight (ppmw) to 5,000 ppmw.

12. The functional fluid of claim 9 wherein the detergent additive (c) is present in an amount in the range of from 1 parts per million by weight (ppmw) to 5,000 ppmw.

13. The functional fluid of claim 1 wherein the base fluid is a lubricating oil.

14. A process for the preparation of a functional fluid of claim 1 comprising bringing into admixture the base fluid, the reaction product (b) and the detergent additive (c).

15. The functional fluid of claim 2 wherein the reaction product (b) comprises said polysubstituted alkanol amine derivatives in an amount of more than 40 wt. %, based on the total weight of the reaction product (b).

16. The functional fluid of claim 2 wherein the reaction product (b) comprises said polysubstituted alkanol amine derivatives in an amount of more than 60 wt. %, based on the total weight of the reaction product (b).

17. The functional fluid of claim 1 wherein said range of molar ratio of the —COO— groups of the carboxylate compound of formula I to the molar sum of —OH and —NH— groups of the alkanol amine of formula II is equal to or less than 1.

18. The functional fluid of claim 17, wherein said range of molar ratio of the —COO— groups of the carboxylate compound of formula I to the molar sum of —OH and —NH— groups of the alkanol amine of formula II is about 1.8:3 to 3:3.

19. The functional fluid of claim 18 wherein said range of molar ratio of the —COO— groups of the carboxylate compound of formula I to the molar sum of —OH and —NH— groups of the alkanol amine of formula II is about 1.9:3 to 2.5:3.

* * * * *